US011339796B2

(12) United States Patent
Wang et al.

(10) Patent No.: US 11,339,796 B2
(45) Date of Patent: May 24, 2022

(54) FAN

(71) Applicant: Acer Incorporated, New Taipei (TW)

(72) Inventors: Chun-Chieh Wang, New Taipei (TW); Wen-Neng Liao, New Taipei (TW); Cheng-Wen Hsieh, New Taipei (TW); Yu-Ming Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 95 days.

(21) Appl. No.: 16/703,869

(22) Filed: Dec. 5, 2019

(65) Prior Publication Data

US 2020/0182253 A1 Jun. 11, 2020

(30) Foreign Application Priority Data

Dec. 7, 2018 (TW) ..... 107144153

(51) Int. Cl.

| | |
|---|---|
| ***F04D 29/30*** | (2006.01) |
| ***F04D 27/00*** | (2006.01) |
| ***F04D 29/32*** | (2006.01) |
| ***F04D 29/02*** | (2006.01) |
| ***F04D 29/34*** | (2006.01) |
| ***F04D 29/38*** | (2006.01) |
| ***F04D 29/28*** | (2006.01) |

(52) U.S. Cl.

CPC ..... *F04D 29/305* (2013.01); *F04D 27/002* (2013.01); *F04D 29/023* (2013.01); *F04D 29/282* (2013.01); *F04D 29/329* (2013.01); *F04D 29/34* (2013.01); *F04D 29/384* (2013.01); *F04D 29/388* (2013.01)

(58) Field of Classification Search

None

See application file for complete search history.

(56) References Cited

U.S. PATENT DOCUMENTS 5,066,196 A * 11/1991 Morofushi ..... F04D 29/384 416/241 A
7,494,325 B2 * 2/2009 Gustafson ..... F04D 29/384 415/914

(Continued)

FOREIGN PATENT DOCUMENTS

CN 1088667 6/1994
CN 101368575 2/2009

(Continued)

OTHER PUBLICATIONS

"Office Action of Taiwan Counterpart Application", dated Mar. 31, 2020, p. 1-p. 7.

*Primary Examiner* — Juan G Flores
(74) *Attorney, Agent, or Firm* — JCIPRNET

(57) ABSTRACT

A fan blade includes an arch-shaped body, a connecting portion, at least one sheet and at least one reinforcement component. The arch-shaped body has a pressure bearing surface and a negative pressure surface opposite to the pressure bearing surface. The connecting portion is connected to a first end portion of the arch-shaped body. The sheet is connected to the pressure bearing surface or the negative pressure surface. The reinforcement component is connected to the pressure bearing surface. An orthogonal projection of the sheet on the arch-shaped body and an orthogonal projection of the reinforcement component on the arch-shaped body are not overlapped with each other. A fan is also provided.

6 Claims, 3 Drawing Sheets

(56) References Cited

U.S. PATENT DOCUMENTS

| | | | | |
|---|---|---|---|---|
| 2003/0044281 | A1* | 3/2003 | Kim | F04D 29/30<br>416/186 R |
| 2012/0156042 | A1* | 6/2012 | Li | F04D 29/388<br>416/204 R |

FOREIGN PATENT DOCUMENTS

| | | | | |
|---|---|---|---|---|
| CN | 201786741 | | 4/2011 | |
| CN | 201891661 | | 7/2011 | |
| CN | 102312682 | | 1/2012 | |
| CN | 101463832 | | 9/2012 | |
| CN | 103032371 | | 4/2013 | |
| CN | 205478538 | | 8/2016 | |
| CN | 106438471 | | 2/2017 | |
| CN | 107152414 | | 9/2017 | |
| CN | 107407290 | | 11/2017 | |
| CN | 206738239 | | 12/2017 | |
| DE | 102015224096 | | 6/2017 | |
| GB | 887100 | | 1/1962 | |
| JP | 2006097488 | | 4/2006 | |
| KR | 100429997 | | 5/2004 | |
| TW | M402943 | | 5/2011 | |
| TW | M469387 | | 1/2014 | |
| TW | M470165 | | 1/2014 | |
| TW | I618863 | | 3/2018 | |
| WO | WO-2013092289 | A1 * | 6/2013 | F04D 29/30 |

* cited by examiner

FAN

CROSS-REFERENCE TO RELATED APPLICATION

This application claims the priority benefit of Taiwan application serial no. 107144153, filed on Dec. 7 2018. The entirety of the above-mentioned patent application is hereby incorporated by reference herein and made a part of this specification.

BACKGROUND

Technical Field

The disclosure relates to a fan blade and a fan, in particular, to a fan blade and a fan using the same.

Description of Related Art

With the development of technology, electronic devices such as desktop computers, notebook computers and smart phones have been frequently used in daily life. In order to meet the design requirements of thin product having high and efficient computing capability, how to dissipate the heat generated by the electronic device during operation to improve the performance of the electronic device has become one of the most important issues at present.

In general, most of the electronic device are equipped with a cooling fan inside to help quickly dissipate the heat generated by the electronic device during operation to the outside of the electronic device. Recently, the cooling fan adopts metal fan blades, and the metal blade is usually produced by die casting process or stamping process, etc. After being produced, it is difficult to adjust or change the geometric shape or the size of the metal blade. Therefore, during the operation of the cooling fan, if the air volume needs being increased, the speed of the fan must be increased. If the speed is not changed, a cooling fan with a larger area of the fan blade must be produced or purchased.

SUMMARY

The disclosure provides a fan blade and a fan having controllable and adjustable geometric shape while operating, in order to improve heat dissipation efficiency.

A fan blade of the disclosure includes an arch-shaped body, a connecting portion, at least one sheet and at least one reinforcement component. The arch-shaped body has a pressure bearing surface and a negative pressure surface opposite to the pressure bearing surface. The connecting portion is connected to a first end portion of the arch-shaped body. The sheet is connected to the pressure bearing surface or the negative pressure surface. The reinforcement component is connected to the pressure bearing surface, and an orthogonal projection of the sheet on the arch-shaped body and an orthogonal projection of the reinforcement component on the arch-shaped body are not overlapped with each other.

A fan of the disclosure includes a hub and a plurality of fan blades. The fan blades are arranged around the periphery of the hub. Each of the fan blades includes an arch-shaped body, a connecting portion, at least one sheet and at least one reinforcement component. The arch-shaped body has a pressure bearing surface and a negative pressure surface opposite to the pressure bearing surface. The connecting portion is connected to a first end portion of the arch-shaped body, and the arch-shaped body is connected to the hub through the connecting portion. The sheet is connected to the pressure bearing surface or the negative pressure surface. The reinforcement component is connected to the pressure bearing surface, and an orthogonal projection of the sheet on the arch-shaped body and an orthogonal projection of the reinforcement component on the arch-shaped body are not overlapped with each other.

Based on the above, the fan of the disclosure adopts the fan blade having controllable and adjustable geometric shape while the fan operates. In addition, the geometric shape of the fan blade changes while the fan operates, thereby achieving the purposes of changing the air pressure, changing the air volume and changing the angle of the outflow, in order to improve heat dissipation efficiency.

In order to make the aforementioned and other features and advantages of the disclosure more comprehensible, embodiments accompanying figures are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
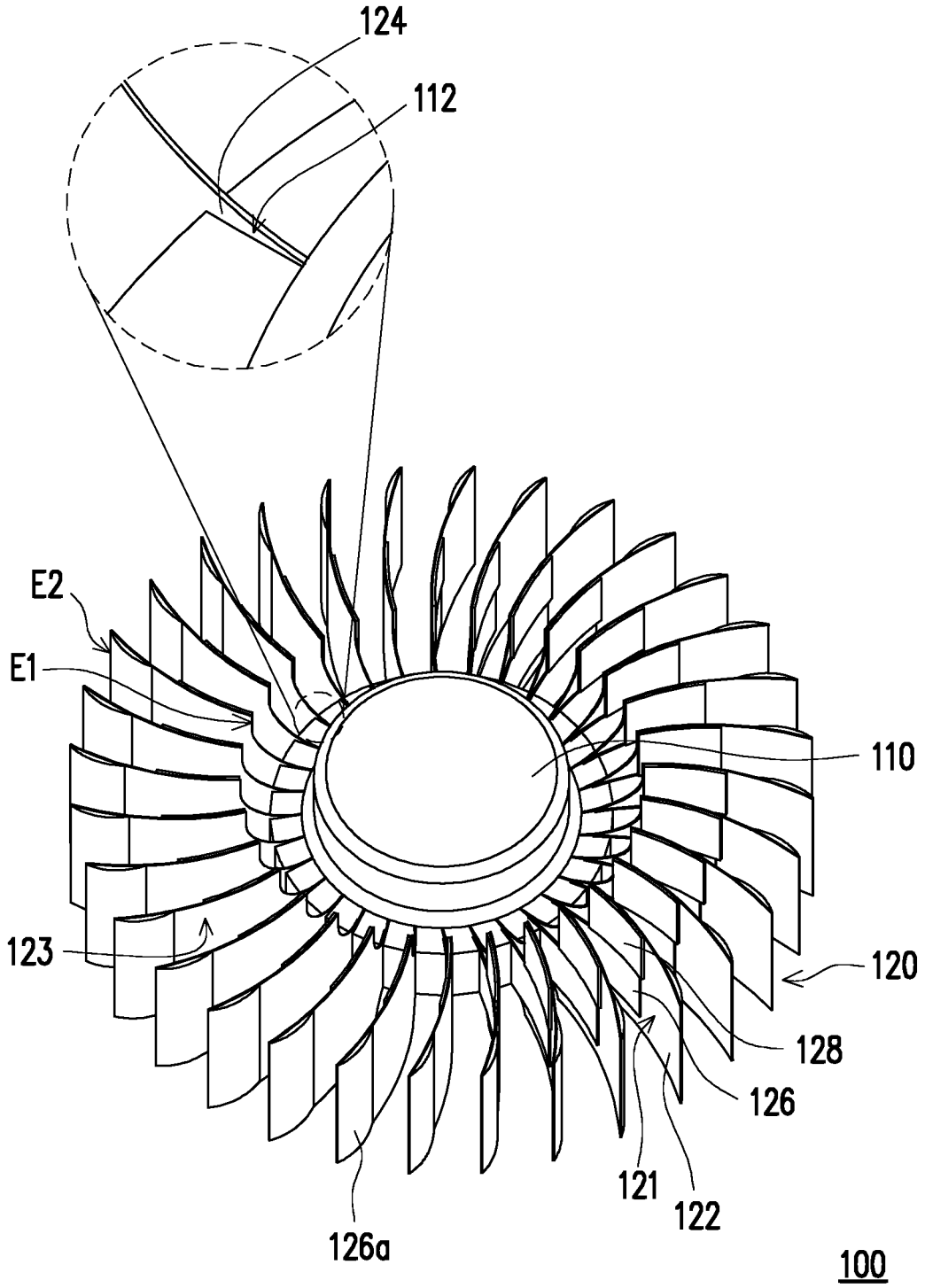
FIG. 1 is a schematic view of a fan according to the first embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Figure 2:
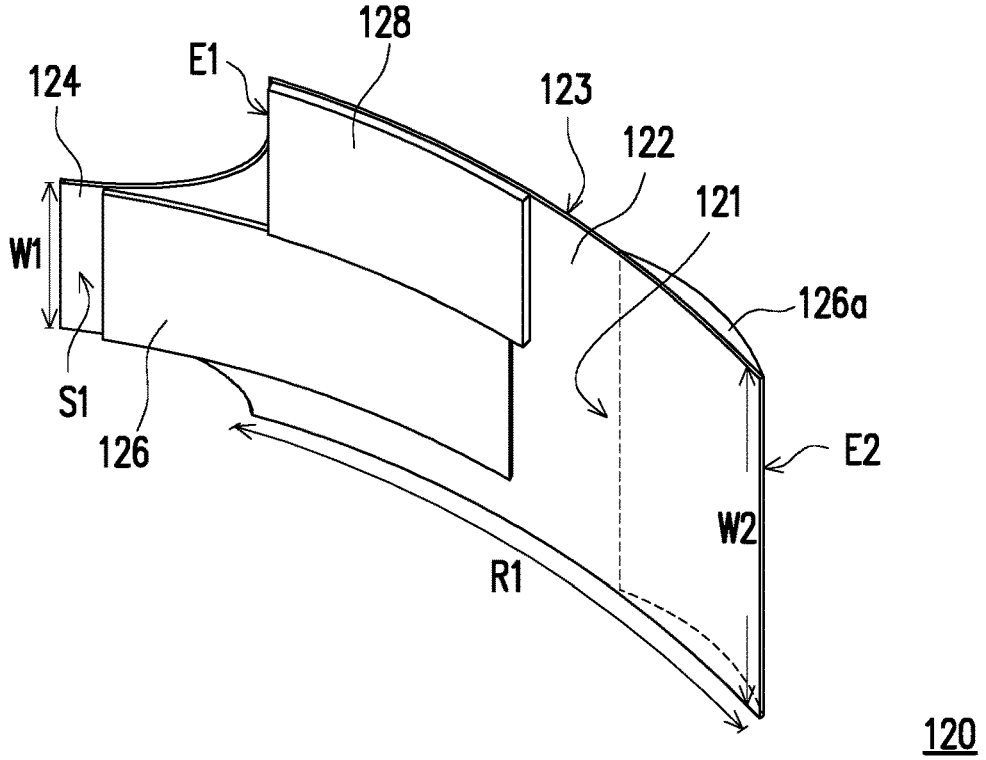
FIG. 2 is a schematic view illustrating structure of a fan blade in FIG. 1.

FIG. 1 is a schematic view of a fan according to the first embodiment of the disclosure. FIG. 2 is a schematic view illustrating structure of a fan blade in FIG. 1. Referring to FIGS. 1 and 2, in the present embodiment, a fan 100, such as a centrifugal fan, includes a hub 110 and a plurality of fan blades 120, and the fan blades 120 are arranged around the periphery of the hub 110. In general, the hub 110 is coupled to a power source such as motor (not shown), and is driven by the power source to rotate about a rotation axis. At the same time, the fan blades 120 rotating along with the hub 110 can generate the airflow, in order to dissipate heat from the heat source.

The material of the hub 110 may be plastic or metal, and thus may be produced by injection molding or die casting. On the other hand, each of the fan blades 120 includes an arch-shaped body 122 and a connecting portion 124, and the arch-shaped body 122 is connected with the connecting portion 124 and is connected to the hub 110 through the connecting portion 124. For instance, each of the connecting portions 124 may be inserted to or engaged with an inserting groove 112 of the hub 110. The fan blades 120 are metal fan blades as an example, and may be produced by die casting or stamping process or the like. In other words, the arch-shaped body 122 and the connecting portion 124 are integrally formed structure which has a better reliability.

In the present embodiment, in each of the fan blades 120, the arch-shaped body 122 has a pressure bearing surface 121, a negative pressure surface 123 opposite to the pressure bearing surface 121, the first end portion E1, and the second end portion E2 opposite to the first end portion E1. The connecting portion 124 is connected to the first end portion E1, and the second end portion E2 and the connecting portion 124 are respectively located at two opposite sides of the first end portion E1. On the other hand, each of the fan blade 120 further includes the first sheet 126 and a reinforcement component 128. The first sheet 126 and the reinforcement component 128 are both connected to the pressure bearing surface 121, and an orthogonal projection of the first sheet 126 on the arch-shaped body 122 and an orthogonal projection of the reinforcement component 128 on the arch-shaped body 122 are not overlapped with each other.

To be more specific, the first sheet 126 extends from the arch-shaped body 122 to a surface S1 of the connecting portion 124 which is connected to the pressure bearing surface 121. In other words, one part of the first sheet 126 is located on the surface S1 of the connecting portion 124, and the other part of the first sheet 126 is located on the pressure bearing surface 121. In the present embodiment, the part of the first sheet 126 which is located on the connecting portion 124 may be inserted into or engaged with the inserting groove 112 on the hub 110, and is configured to strengthen the rigidity of the connecting portion 124, so as to prevent the situation that permanent deformation is caused at the periphery of the connecting portion 124 because the fan blade 120 withstands pressure while the fan 100 rotates.

On the other hand, each of the fan blades 120 further includes the second sheet 126*a*, and the second sheet 126*a* is connected to the negative pressure surface 123 and is located on the second end portion E2 of the arch-shaped body 122. Furthermore, one side edge of the second sheet 126*a* is aligned with the side edge of the second end portion E2 and extends from the second end portion E2 towards the first end portion E1. The arc length of the second sheet 126*a* extended from the second end portion E2 towards the first end portion E1 is smaller than or equal to one third of an arc length R1 of the arch-shaped body 122.

Referring to FIG. 2, the orthogonal projection of the first sheet 126 on the arch-shaped body 122, an orthogonal projection of the second sheet 126*a* on the arch-shaped body 122, and the orthogonal projection of the reinforcement component 128 on the arch-shaped body 122 are not overlapped with each other. In other words, other than area of the orthogonal projection of the first sheet 126 on the arch-shaped body 122 and the orthogonal projection of the second sheet 126*a* on the arch-shaped body 122, the remaining area on the arch-shaped body 122 is configured to be disposed with the reinforcement component 128 that has size according to design requirements. In the present embodiment, the reinforcement component 128 has rigidity greater than the first sheet 126 and the second sheet 126*a* and is configured to strengthen the structural rigidity of a part of the arch-shaped body 122. Therefore, during the operation of the fan 100, based on the relative arrangement and the difference in rigidity among the first sheet 126, the second sheet 126*a*, and the reinforcement component 128, the geometric shape of the fan blade 120 changes due to bearing pressure and different regions have different deformation degrees and different angle variations, thereby achieving the purposes of changing the air pressure, changing the air volume and changing the angle of the outflow, in order to improve heat dissipation efficiency.

On the other hand, the first sheet 126 and the second sheet 126*a* may be made of plastic materials and are formed on the fan blade 120 by an injection molding process, so as to conform with the curvature of the fan blade 120. In addition, the second sheet 126*a* disposed on the negative pressure surface 123 has a cambered surface to guide the airflow, but the disclosure is not limited thereto. In the present embodiment, the width of the first sheet 126 is smaller than or equal to the width W1 of the connecting portion 124, and the first sheet 126 extends with the same width from the surface S1 of the connecting portion 124 to the pressure bearing surface 121. In other words, the width at the part of the first sheet 126 located on the pressure bearing surface 121 is equal to the width W1 of the connecting portion 124. In other embodiment, the first sheet extends from the surface of the connecting portion to the pressure bearing surface and the width of the first sheet may be gradually increased or decreased from the surface of the connecting portion to the pressure bearing surface. In other words, the width of the first sheet at the part located on the pressure bearing surface may be greater than or smaller than the width at the part located on the connecting portion.

On the other hand, the width of the second sheet 126*a* is equal to a width W2 of the second end portion E2, and the second sheet 126*a* extends with the same width from the second end portion E2 towards the first end portion E1 as an example. In other embodiment, the second sheet extends from the second end portion towards the first end portion the width of the second sheet may be gradually decreased from the second end portion towards the first end portion. In another embodiment, the width of the second sheet may be smaller than the width of the second end portion, and the second sheet may extend with the same width from the second end portion towards the first end portion, or the width of the second sheet may be gradually increased or decreased from the second end portion towards the first end portion. Herein, the material of the reinforcement component 128 may be high molecular material, composite material, or metal, etc., and the reinforcement component 128 is attached, adhered or welded to the pressure bearing surface 121.

Other embodiments of the fan blade are described hereinafter. The fan blades in the other embodiments can be applied to the fan of the disclosure, the fan blades of the other embodiments adopt the same design principle as or similar design principle to the fan blade of the first embodiment, so as to have same or similar structures. Thus, descriptions about the technical contents and effects the same as those of the first embodiment are omitted in the embodiments.

Figure 3:
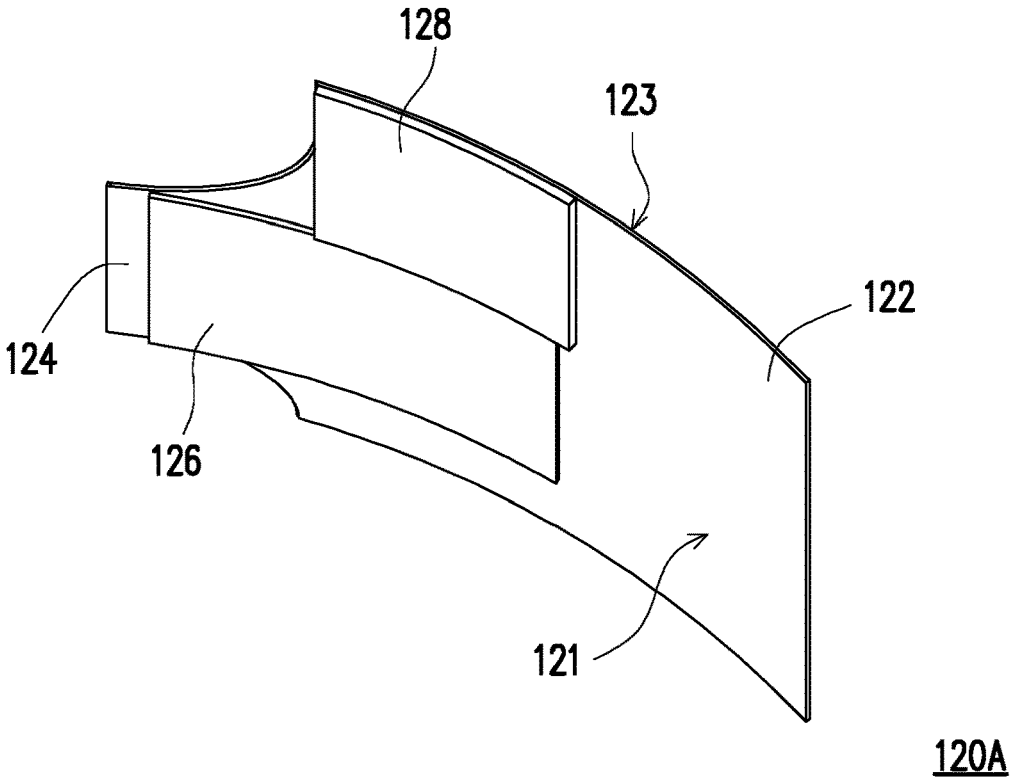
FIG. 3 is a schematic view illustrating structure of a fan blade according to the second embodiment of the disclosure.

FIG. 3 is a schematic view illustrating structure of a fan blade according to the second embodiment of the disclosure. With reference to FIG. 3, A fan blade 120A of the present embodiment and the fan blade 120 of the first embodiment are substantially similar, the difference is that the fan blade 120A does not have the second sheet 126*a* disposed on the negative pressure surface 123.

Figure 4:
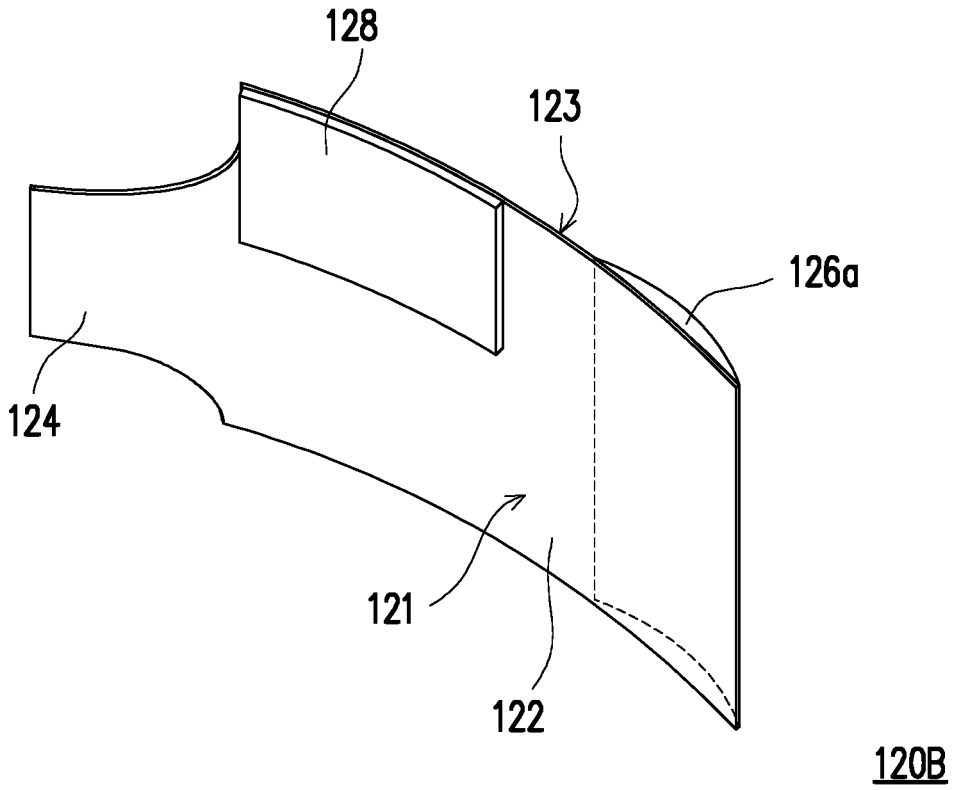
FIG. 4 is a schematic view illustrating structure of a fan blade according to the third embodiment of the disclosure.

FIG. 4 is a schematic view illustrating structure of a fan blade according to the third embodiment of the disclosure. With reference to FIG. 4, A fan blade 120B of the present embodiment and the fan blade 120 of the first embodiment are substantially similar, the difference is that the fan blade 120A does not have the first sheet 126 disposed on the pressure bearing surface 121.

Figure 5:
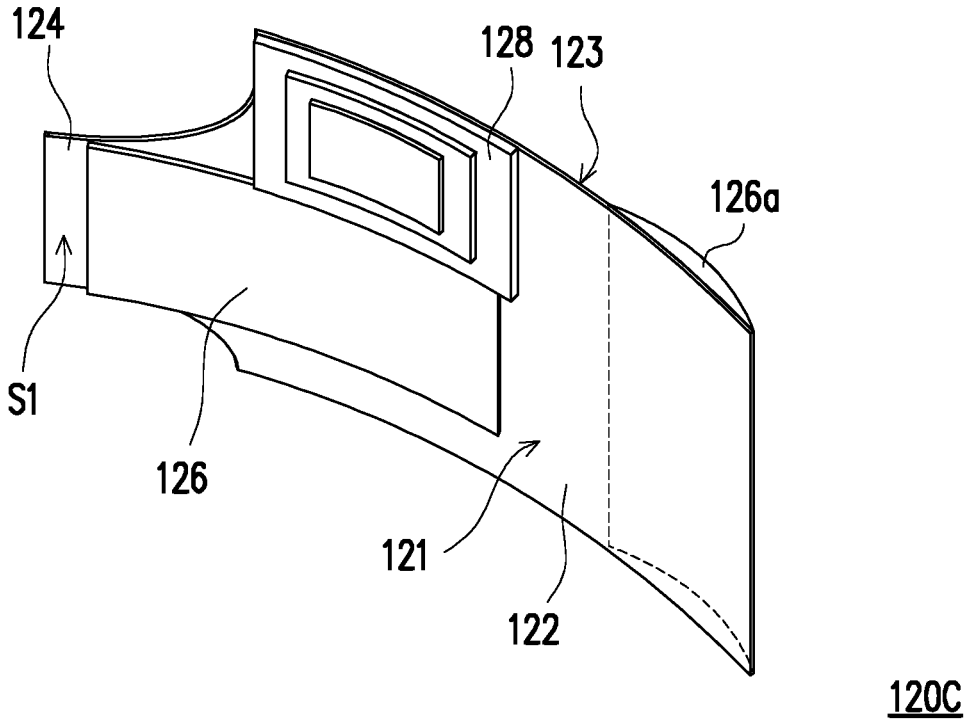
FIG. 5 is a schematic view illustrating structure of a fan blade according to the fourth embodiment of the disclosure.

FIG. 5 is a schematic view illustrating structure of a fan blade according to the fourth embodiment of the disclosure. A fan blade 120C of the present embodiment and the fan blade 120 of the first embodiment are substantially similar, the difference is that, in the present embodiment, the number of the reinforcement components 128 is plural, and the reinforcement components 128 are stacked on the pressure bearing surface 121. On the other hand, the size of one the reinforcement components 128 which is closer to the pressure bearing surface 121 is greater than the size of the other one of reinforcement component 128 which is further away from the pressure bearing surface 121. It is worth mentioning that, in the previous embodiments, the number of the reinforcement components 128 in each of the fan blade 120, the fan blade 120A, and the fan blade 120B may also be plural, and the reinforcement components 128 are also stacked on the pressure bearing surface 121. In other embodiments, the reinforcement components may not be stacked, and may be distributed on an area other than the orthogonal projection of the first sheet on the arch-shaped body and/or the orthogonal projection of the second sheet on the arch-shaped body.

In summary, the fan of the disclosure adopts the fan blade that is designed to have the sheet and the reinforcement component disposed thereon. According to locations of the sheet and the reinforcement component on the fan blade, the geometric shape of the fan blade can be controlled and adjusted while the fan operates. In addition, the geometric shape of the fan blade changes while the fan operates, thereby achieving the purposes of changing the air pressure, changing the air volume and changing the angle of the outflow, in order to improve heat dissipation efficiency. On the other hand, by the cooperation of the sheet and the reinforcing member, the fan blade may have different degrees of deformation when the fan rotates, so that it is not necessary to manufacture or purchase a plurality of fan blades having different geometric shapes, thereby saving cost.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A fan, comprising:

a hub; and a plurality of fan blades, arranged around a periphery of the hub, and each of the fan blades comprising:

an arch-shaped body, having a pressure bearing surface and a negative pressure surface opposite to the pressure bearing surface;

a connecting portion, connected to a first end portion of the arch-shaped body, and the arch-shaped body being connected to the hub through the connecting portion;

at least one sheet, connected to the pressure bearing surface or the negative pressure surface; and at least one reinforcement component, connected to the pressure bearing surface, wherein an orthogonal projection of the at least one sheet on the arch-shaped body and an orthogonal projection of the at least one reinforcement component on the arch-shaped body are not overlapped with each other, a rigidity of the at least one reinforcement component is greater than a rigidity of the at least one sheet, wherein a part of the at least one sheet is located on the connecting portion and inserted into the hub.

2. The fan as recited in claim 1, wherein the at least one sheet of each of the fan blades is connected to the pressure bearing surface and extends from the arch-shaped body to a surface of the connecting portion which is connected to the pressure bearing surface.

3. The fan as recited in claim 1, wherein the at least one sheet of each of the fan blades is connected to the negative pressure surface and is located at a second end portion of the arch-shaped body which is opposite to the first end portion.

4. The fan as recited in claim 1, wherein a number of the at least one sheet of each of the fan blades is two, one of the two sheets is connected to the pressure bearing surface and extends from the arch-shaped body to a surface of the connecting portion which is connected to the pressure bearing surface, another one of the two sheets is connected to the negative pressure surface and is located at a second end portion of the arch-shaped body which is opposite to the first end portion.

5. The fan as recited in claim 4, wherein, in each of the of fan blades, an orthogonal projection of the one of the sheets on the arch-shaped body and an orthogonal projection of the another one of the sheets on the arch-shaped body are not overlapped with each other.

6. The fan as recited in claim 1, wherein a number of the at least one reinforcement component of each of the fan blades is plural and the reinforcement components are stacked on the pressure bearing surface.

* * * * *